US005160207A

United States Patent [19]

Woo

[11] Patent Number: 5,160,207

[45] Date of Patent: Nov. 3, 1992

[54] MECHANISM FOR CORRECTING THE PRINTING POSITION OF AN ELECTRONIC TYPEWRITER

[75] Inventor: Haeng-Cho Woo, Sungnam, Rep. of Korea

[73] Assignee: Samsung Electronics Co., Ltd., Suwon, Rep. of Korea

[21] Appl. No.: 606,757

[22] Filed: Oct. 31, 1990

[30] Foreign Application Priority Data

Jan. 5, 1990 [KR] Rep. of Korea ..... 1990-42

[51] Int. Cl.[5] ..... B41J 33/14; B41J 35/27; B41J 29/36

[52] U.S. Cl. ..... 400/697.1; 400/214; 400/212; 400/216.1

[58] Field of Search ..... 400/214, 695, 697, 223, 400/225, 696, 208, 697.1, 212, 216.1, 216.4, 216.5

[56] References Cited

U.S. PATENT DOCUMENTS

| | | | |
|---|---|---|---|
| 4,472,073 | 9/1984 | Valle et al. | 400/214 |
| 4,533,267 | 8/1985 | Kurachi et al. | 400/214 |
| 4,573,813 | 3/1986 | Aoki et al. | 400/214 |
| 4,589,788 | 5/1986 | Lendl | 400/214 |
| 4,637,744 | 1/1987 | Valle et al. | 400/214 |
| 4,728,208 | 3/1988 | Iwase et al. | 400/214 |
| 4,840,505 | 6/1989 | Kurokawa | 400/214 |

FOREIGN PATENT DOCUMENTS

| | | | |
|---|---|---|---|
| 118317 | 9/1984 | European Pat. Off. | 400/214 |
| 158491 | 7/1986 | Japan | 400/214 |
| 54278 | 3/1988 | Japan | 400/214 |
| 2176747 | 1/1987 | United Kingdom | 400/214 |

*Primary Examiner*—Clifford D. Crowder
*Assistant Examiner*—J. R. Keating
*Attorney, Agent, or Firm*—Robert E. Bushnell

[57] ABSTRACT

There is provided a mechanism for correcting the printing position of an electronic typewriter comprising a working pin attached to a ribbon bracket, the working pin cooperating with a ribbon cam so as to move the ribbon bracket to a printing or correction position, a coil spring for resiliently supporting the working pin, a printing track groove and correction track groove formed in one side of the ribbon cam and connected to each other, a correction angle formed between the starting points of the printing and correction grooves, and two slopes respectively formed in the starting points of the grooves. The lower ends of a push pawl and pawl locker are connected to carriage body respectively by means of a push pawl coil spring and pawl locker coil spring. A push cam is rotated by the turning force of a motor transmitted via an idle gear and following gear, and the pawl locker contacts the push pawl locker of the push pawl.

3 Claims, 5 Drawing Sheets

MECHANISM FOR CORRECTING THE PRINTING POSITION OF AN ELECTRONIC TYPEWRITER

BACKGROUND OF THE INVENTION

The present invention relates to a mechanism for correcting the printing position of an electronic typewriter, wherein the means for lifting and lowering a ribbon is simplified so as to considerably reduce mechanical noises, simplify the assembling process and decrease the cost of production.

A conventional mechanism for correcting the printing position of an electronic typewriter is disclosed in U.S. Pat. No. 4,728,208, wherein as the cam for lifting and lowering a ribbon is rotated to lift and lower the ribbon according to the internal configuration of the cam, the external configuration of the cam causes a stopper lingking a pawl to be moved by linkage, so that the pawl together with the stopper is rotated reversely to the rotation of the cam. In this case, the stopper is blocked by the shoulder of a guide cam so as to prevent a positional change of the ribbon occurring in the configuration of the conventional cam during printing, and when the rotation of the cam is reversed, the pawl together with the stopper is also reversely rotated, so that the stopper is separated from the shoulder of the cam so as to move the ribbon to the correction position. Thus, a two-sided cam is employed to correct the ribbon position, so that it is difficult to manufacture the mould for the cam, the cost of production is increased and the precision of the components is hardly maintained. Further, a complicated link mechanism is needed in order to work the pawl and stopper. Besides, due to the friction simultaneously occurring at the both sides of the cam, excessive torque should be afforded by the motor.

SUMMARY OF THE INVENTION

The object of the present invention is to obviate such conventional drawbacks.

According to the present invention, there is provided a mechanism for correcting the printing position of an electronic typewriter comprising a carriage body, a ribbon bracket, a pivot pin for pivotably mounting the carriage body and ribbon bracket, the carriage body and ribbon bracket being connected to each other by means of a coil spring, a ribbon cam for lifting and lowering a ribbon, a motor for rotating the ribbon cam, a cam guide with a working pin attached to the ribbon bracket, the working pin cooperating with the ribbon cam so as to move the ribbon bracket to a printing or correction position, another coil spring for resiliently supporting the working pin, a printing track groove and correction track groove formed in one side of the ribbon cam and connected to each other, a correction angle formed between the starting points of the printing and correction grooves, two slopes respectively formed in the starting points of the grooves, a following gear, and push cam fixedly attached to one side of the ribbon cam, a push pawl having a push pawl locker projected at the upper end thereof, a pawl locker, an idle gear, a gear pivot pin for rotatably attaching the push pawl, pawl locker and idle gear to the carriage body which are separately rotated, the lower ends of the push pawl and pawl locker being connected to the carriage body respectively by means of a push coil spring and pawl locker coil spring, the push cam being rotated by the turning force of the motor transmitted via the idle gear and following gear, and the pawl locker contacting the push pawl locker of the push pawl.

The present invention will now be described more specifically with reference to the drawings attached only by way of example.

DETAILED DESCRIPTION OF THE PREFERRED EMBODIMENT

Figure 1:
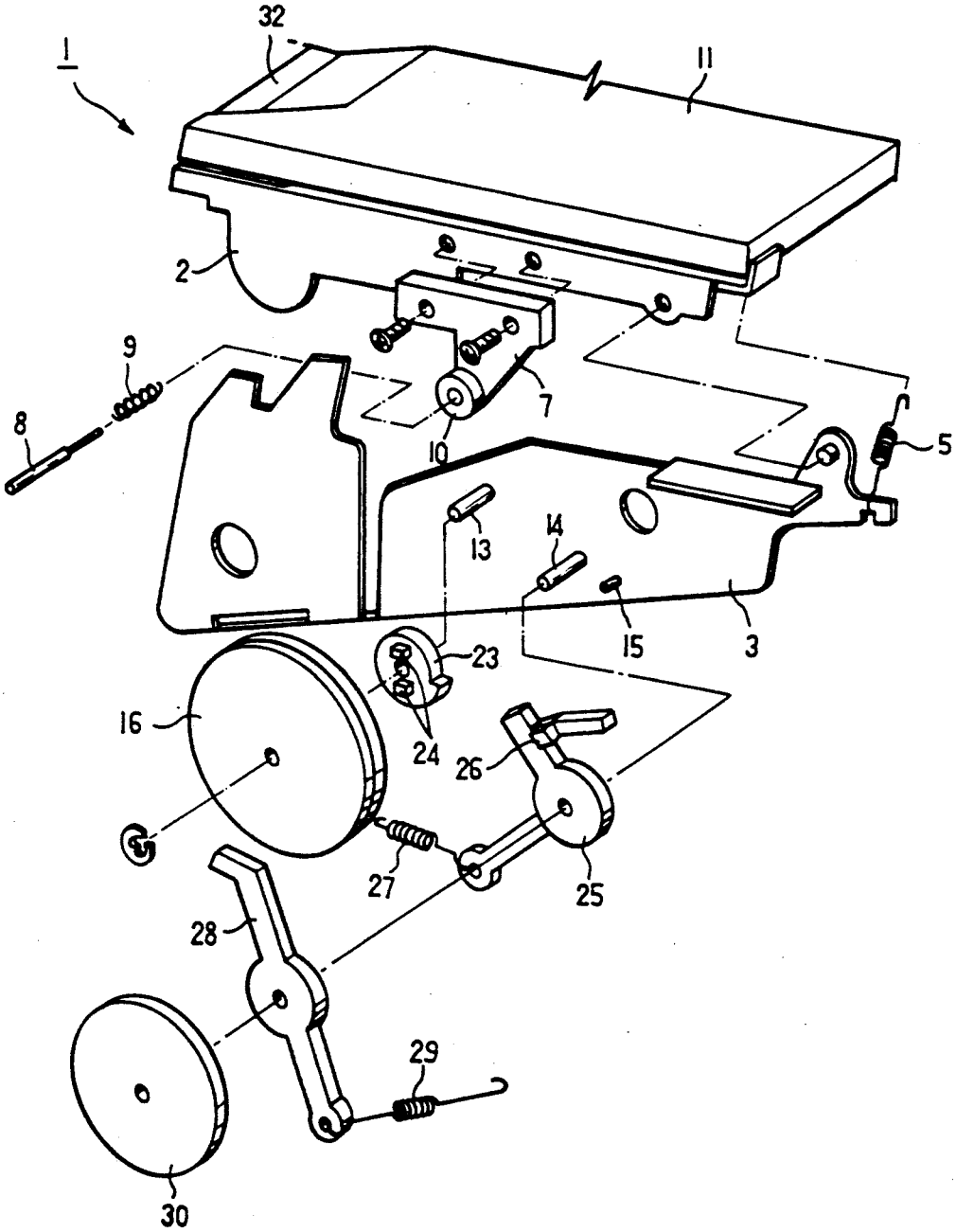
FIG. 1 is an exploded perspective view of a mechanism according to the present invention.

Reference is made to FIGS. 1–6 for detailed description of the present invention. A mechanism 1 for correcting the printing position of an electronic typewriter comprises a carriage body 3 and a ribbon bracket 2. Their rear end portions are pivotably connected to each other by means of a pivot pin 4, and the ribbon bracket 2 is usually urged upwards by a coil spring 5.

On the lower part of the ribbon bracket 2 is fixed a cam guide 7 with a small cylindrically shaped projection 10, into which a cam guide pin 8 is inserted and resiliently supported by a coil spring 9. Thus, the cam guide pin 8 may resiliently reciprocate inwardly and outwardly of the cam guide 7. A ribbon cassette 11 and correction ribbon 12 are mounted on the ribbon bracket 2.

Figure 5:
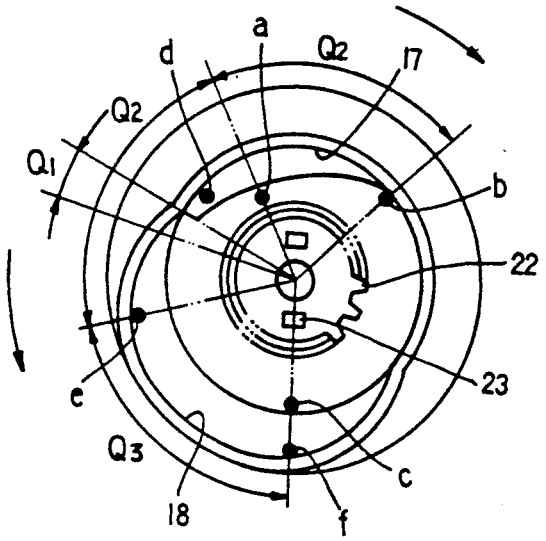
FIG. 5 is a side view of a working cam for lifting and lowering a ribbon according to the present invention.
Figure 6:
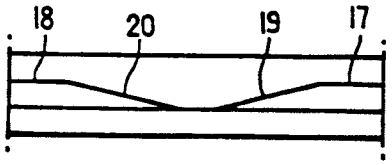
FIG. 6 is a cross sectional view along line A—A' of FIG. 5.

There are formed on the carriage body 3 a cam pivot pin 13, a gear pivot pin 14 and a pawl stopper 15. A ribbon cam 16 for lifting and lowering a ribbon has on one side thereof a printing track groove 17 and a correction track groove 18 integrally connected to each other as shown in FIG. 5. A correction angle "$Q_1$" is formed between the starting points of the printing and correction track grooves 17 and 18, where there are formed two slopes 19 and 20 as shown in FIG. 6.

A push cam 23 has engaging projection 24 engaged with engaging slot 21 so as to integrate the cam 16 and the push cam 23, which are rotatably mounted on the cam pivot pin 13 of the carriage body 3.

The cam guide pin 8 of the cam guide 7 moves along the printing and correction track grooves 17 and 18 so as to move the ribbon bracket 2 to the printing or correction position with the help of the resilient force of the coil spring 5.

A push pawl 25 with a push pawl locker 26 projected on the upper end thereof is pivotably mounted on the gear pivot pin 14, and has a lower end resiliently connected to the carriage body 3 via a push pawl coil spring 27. The push pawl 25 contacts the push cam 23, and is normally pivoted clockwise by the elastic force of the coil spring 27.

A pawl locker 28 is pivotably mounted on the gear pivot pin 14, and has an upper end to be locked or unlocked by the push pawl locker 26 of the push pawl 25 and a lower end resiliently connected to the carriage body 3 via a pawl locker coil spring 29, whereby it is normally pivoted counterclockwise held by the pawl stopper 15. The elastic force of the pawl locker coil spring 29 is necessarily stronger than that of the push pawl coil spring 27.

An idle gear 30 is rotatably mounted on the gear pivot pin 14, engaged with the following gear 22 of the ribbon cam 16 and the main gear of the motor 31. The reference numeral 32 represents the ribbon.

Figure 2:
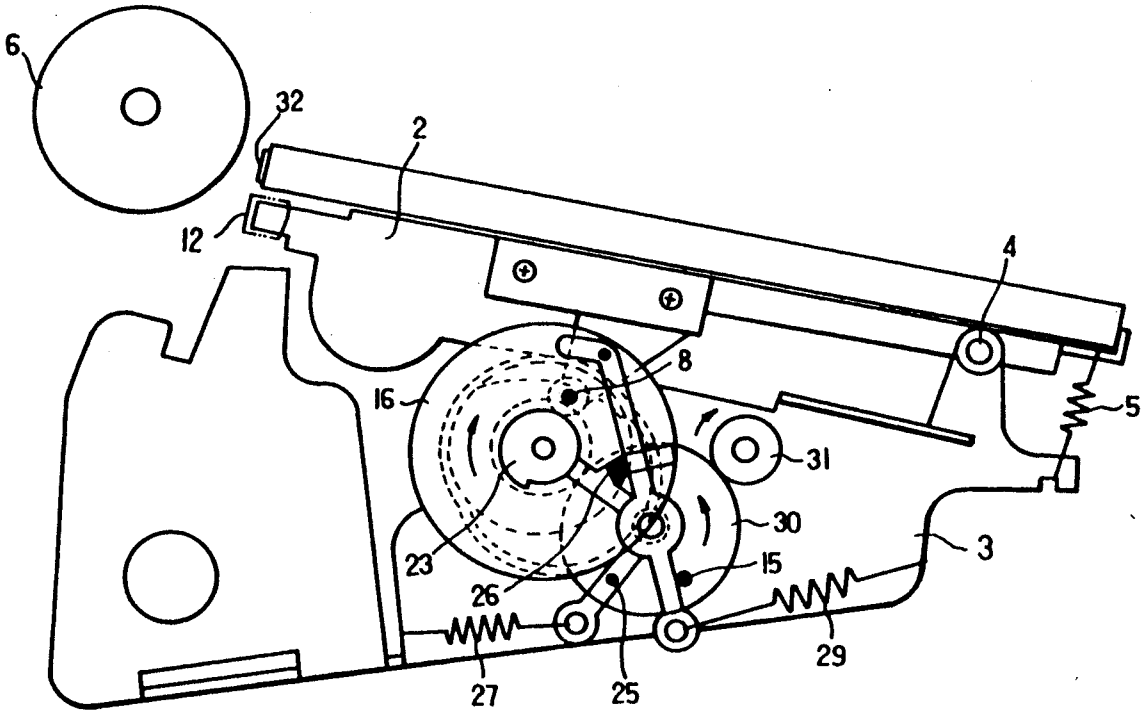
FIG. 2 is a side view of the mechanism of FIG. 1, which is put outside the printing and the correction positions.

FIG. 2 shows the original position of the ribbon bracket 2, where the inventive mechanism is put outside the printing and correction positions. Here, the position of the ribbon cam 16 indicates that the cam guide pin 8 is placed in the position "a" as shown in FIG. 5.

Figure 3:
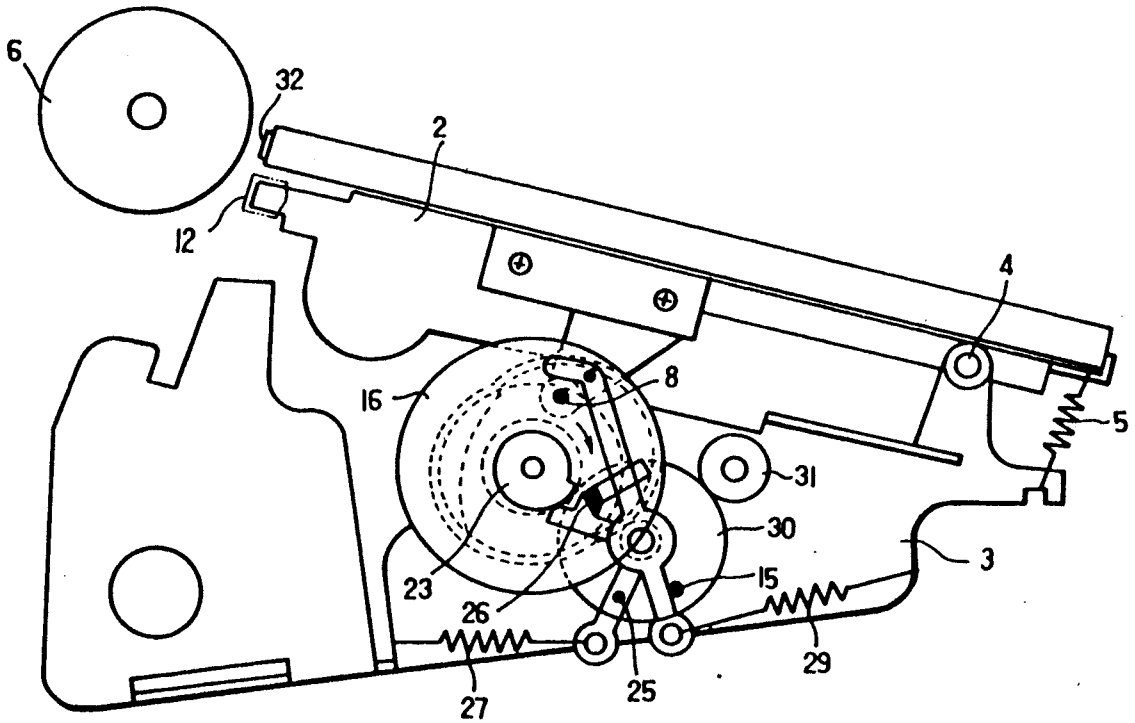
FIG. 3 is a side view for illustrating that the mechanism of FIG. 1 is in the printing position.

If the motor 31 is supplied with a power source for printing, the main gear of the motor 31 is rotated clockwise and the idle gear 30 engaged therewith is rotated counterclockwise. Then, the following gear 22 of the cam 16 engaged with the idle gear 30 is rotated clockwise. Hence, the ribbon cam 16 integrated with the following gear 22 is simultaneously rotated, so that the cam guide pin 8 is guided by the printing track groove 17 and the elastic force of the coil spring 5 causes the ribbon bracket 2 to move slightly upwards clockwise about the pivot pin 4 to the printing position, as shown in FIG. 3.

At the same time, the push cam 23 pushes the push pawl 25 downwards (pivoted counterclockwise), and the pawl locker 28 is fixed in its position, while the projection 10 of the cam guide 7 is held by the upper bent shoulder of the pawl locker 28, thus preventing the ribbon bracket 2 from more upward moving. Hence, in the case of a single stroke, there is no problem because the cam guide pin 8 repeats to move through the angle "$Q_2$" to the position "b" and again to the position "a", as shown in FIG. 5, but, in continuous strokes, the cam guide pin 8 is rotated clockwise along the path a-b-c-d so as to continuously pass the position of the angle "$Q_1$", which is the correction angle of the printing and correction track grooves 17 and 18 to make the cam guide pin 8 smoothly move along a substantial circle, so that the ribbon bracket 2 is kept from changing its height for a continuous printing to be performed. Namely, the continuous rotation of the cam 16 should move the position of the cam guide pin 8 from "d" to "b" and not from "a" to "b", so that the printing may be performed without any change of the height of the ribbon bracket 2 during the continuous rotation of the ribbon cam 16.

To this end, the pawl locker 28 holds the projection 10 of the cam guide 7 so as to prevent more upward moving of the ribbon bracket 2, while the push pawl 25 is slightly pivoted clockwise by the elastic force of the push pawl coil spring 27, so that the ribbon cam 16 is freely rotated without the influence of the push cam 23 because the push pawl 25 does not contact the push cam 23. During the rotation of the ribbon cam 16, the cam guide pin 8 is injected in the interval from "d" to "b" and projected in the interval from "b" to "c" by the elastic force of the coil spring 9, thus tracking a substantially circular path. Further, in the interval from "c" to "d", the cam guide pin 8 moves along the slope 19 formed in the cam 16, thus smoothly making a substantially circular motion.

Figure 4:
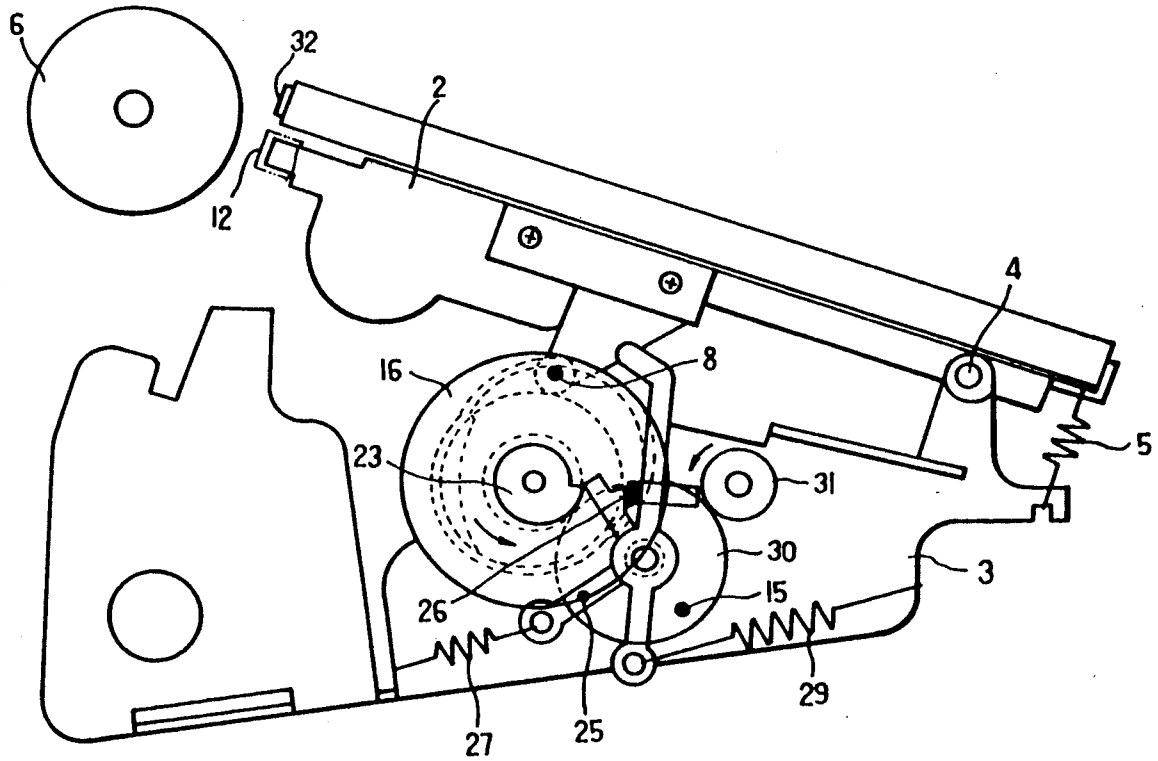
FIG. 4 is a side view for illustrating that the mechanism of FIG. 1 is in the correction position.

When the motor 31 is reversely rotated in order to make a correction, as shown in FIG. 4, the idle gear 30 is rotated clockwise, and thus the following gear 22 engaged with the idle gear 30 is rotated counterclockwise, so that the cam 16 is rotated counterclockwise together with the push cam 23. Then, the cam guide pin 8 moves through the correction angle "$Q_1$" from "a" to the slope 20, and thereafter along the correction track groove 18 in the direction of a→e→f→b→a.

At the same time, the push cam 23 pushes upwards the push pawl 25, whose push pawl locker 26 in turn pushes the upper end of the pawl locker 28 to depart from the projection 10 of the cam guide 7. Of course, the pawl locker 28 pivots clockwise on the gear pivot pin 14 in spite of the elastic force of the pawl locker coil spring 29. Thus, if the cam guide 7 departs from the pawl locker 28, the elastic force of the coil spring 5 causes the ribbon bracket 2 to pivot upwards centering around the pivot pin 4 so as to move the correction ribbon 12 to the printing position to perform the correction function. At this moment, the cam guide pin 8 moves within the angle $Q_3$ between "e" and "f".

When the cam 16 is kept on rotating, the cam guide pin 8 comes back from "f" to b so as to move along the printing track groove 17 downwards to the original printing position, while the elastic force of the pawl locker coil spring 29 causes the pawl locker 28 to pivot counterclockwise so as to make its upper end again hold the cam guide pin 8 of the cam guide 7, thereby retaining the ribbon bracket 2 in the printing position. On the other hand, the push pawl locker 26 of the push pawl 25 is pushed so as to pivot the push pawl 25 counterclockwise to the position of FIG. 3. In this case, the elastic force of the pawl locker coil spring 29 is stronger than that of the push pawl coil spring 27, so as to pivot the push pawl 25 against the elastic force of the coil spring 27.

Thus, the inventive mechanism for correcting the printing position is simplified so as to reduce the number of the components as well as the cost of production, thereby improving the productivity. Further, the necessary torque from the motor is so reduced as to considerably decrease the cost.

What is claimed is:

1. A mechanism for correcting the printing position of an electronic typewriter, comprising:

a carriage body, a ribbon bracket;

a pivot pin for pivotally mounting said carriage body and said ribbon bracket to each other by means of a first coil spring;

a ribbon cam for lifting and lowering a ribbon, said ribbon cam having a printing track groove and a correction track groove formed on one side of said ribbon cam and connected to each other to form a correction angle with two respective slopes between starting points of said printing track groove and said correction track groove, said ribbon cam further having a following gear and a push cam fixedly attached to said one side of said ribbon cam;

a motor for rotating said ribbon cam;

a cam guide having a working pin resiliently supported by a second coil spring, for connecting to said ribbon bracket, said working pin cooperating with said ribbon cam for moving said ribbon bracket to a printing position and a correction position;

a push pawl having a push pawl locker projected at an upper end of said push pawl;

a second pawl locker;

an idle gear for transferring rotations of said motor to said following gear of said ribbon cam to rotate said ribbon cam; and a gear pivot pin for rotatably attaching said push pawl, said second pawl locker and said idle gear to said carriage body, wherein said push pawl, said second pawl locker and said idle gear are separately rotatable, and said push pawl and said second pawl locker respectively having a third and forth coil spring for connecting lower ends of said push pawl and said second pawl locker to said carriage body.

2. A mechanism for correcting the printing position of an electronic typewriter comprising:

a carriage body;

a ribbon bracket;

means for pivotally mounting said carriage body and said ribbon bracket;

first connecting means for connecting said carriage body and said ribbon bracket to each other;

a ribbon cam for lifting and lowering a ribbon;

a motor for rotating said ribbon cam;

a cam guide having a working pin attached to said ribbon bracket, said working pin cooperating with said ribbon cam so as to pivot said ribbon bracket to a printing position and a correction position;

second connecting means for resiliently supporting said working pin;

a printing track groove and correction track groove formed on one side of said ribbon cam and connected to each other to form a correction angle having two respective slopes between starting points of said printing and correction grooves;

a following gear and a push cam fixedly attached to said one side of said ribbon cam;

a push pawl having a push pawl locker projecting at the upper end thereof;

second pawl locker an idle gear;

gear pivot means for rotatably attaching said push pawl, said pawl locker and said idle gear to said carriage body, wherein said push pawl, said second pawl locker and said idle gear are separately rotatable; and third connecting means for connecting lower ends of said push pawl and said second pawl locker to said carriage body respectively, said push cam being rotated by rotational force of said motor transmitted via said idle gear and said following gear, and said second pawl locker contacting the push pawl locker of said push pawl.

3. A mechanism for correcting printing position of an electronic typewriter or a printer, comprising:

a drive motor;

a ribbon bracket having a cam guide, for mounting a printing ribbon and a correction ribbon, said cam guide having a working pin resiliently supported by a first coil spring inserted inside said cam guide;

a ribbon cam pivotally mounted on a carriage body and coupled to be rotated by said drive motor, for shifting said ribbon bracket to a printing position to allow printing with said print ribbon and said correction ribbon, said ribbon cam comprising a following gear, a cam groove formed on one face of said ribbon cam, and a push cam rigidly attached to said one face of said ribbon cam, said cam groove having a reference position for rotation, a printing track groove for directing said working pin of said cam guide to move said printing ribbon of said ribbon bracket to said printing position in response to a first rotation of said ribbon cam in a first direction from said reference position;

a correction track groove for directing said working pin to move said correction ribbon of said ribbon bracket to said printing position in response to a second rotation of said ribbon cam in a second direction from said reference position;

a push pawl in a L-shape pivotally mounted on said carriage body, said push pawl having a first locker rigidly attached at one end of said push pawl and a second spring fixedly attached at another end of said push pawl for controlling movements of said following gear of said ribbon cam; and a second locker pivotally mounted on said carriage body, for defining a maximum limit of movement of said ribbon bracket.

* * * * *